United States Patent [19]

Goins

[11] Patent Number: 4,472,064

[45] Date of Patent: Sep. 18, 1984

[54] METHOD AND APPARATUS FOR BLENDING SOLIDS OR THE LIKE

[75] Inventor: Robert Goins, Bartlesville, Okla.

[73] Assignee: Phillips Petroleum Company, Bartlesville, Okla.

[21] Appl. No.: 360,112

[22] Filed: Mar. 19, 1982

[51] Int. Cl.[3] ..... B01F 5/24; B01F 15/02

[52] U.S. Cl. ..... 366/134; 366/137; 366/177

[58] Field of Search ..... 366/9, 101, 106, 107, 366/366, 338, 341, 134, 136, 137, 140, 177, 184, 191; 222/564; 406/146

[56] References Cited

U.S. PATENT DOCUMENTS

| | | | |
|---|---|---|---|
| 3,106,385 | 10/1963 | Arthur et al. | 366/101 X |
| 3,138,369 | 6/1964 | Bennett et al. | 259/95 |
| 3,158,362 | 11/1964 | Seifarth . | |
| 3,167,306 | 1/1965 | Clark | 366/134 X |
| 3,268,215 | 8/1966 | Burton | 259/180 |
| 3,275,303 | 9/1966 | Goins | 259/95 |
| 3,317,191 | 5/1967 | Brown | 259/4 |
| 3,421,739 | 1/1969 | Alberts et al. | 259/4 |
| 3,456,922 | 7/1969 | Goins | 366/101 X |
| 3,539,154 | 11/1970 | Goins | 259/4 |
| 3,936,037 | 2/1976 | Leonard, Jr. | 259/180 |
| 4,068,828 | 1/1978 | Goins | 366/338 X |
| 4,285,602 | 8/1981 | Hagerty et al. | 366/177 |

OTHER PUBLICATIONS

Sales Bulletin of the Young Industries, Inc., No. 842-202.

*Primary Examiner*—Robert W. Jenkins

[57] ABSTRACT

Particulate materials are blended in a vessel provided with a plurality of vertically extending conduits therein. The vessel comprises a downwardly converging frustoconically shaped bottom wall which defines the lower region of the vessel. The conduits are provided with opening within the upper region of the vessel and the lower ends of the conduits extend through the bottom wall, each commmunicating via a corresponding inclined conduit with a solids outlet at the open bottom of the bottom wall. At least one drain conduit communicates between a corresponding opening in the bottom wall and a corresponding inclined conduit. A baffle is disposed within the vessel separating the upper and lower regions and comprises a downwardly converging inverted generally conical portion spaced above the bottom wall and defining therebetween a downwardly converging annular passage. Various arrangements of positioning and spacing of drain conduits and corresponding openings in the bottom wall are disclosed to improve flow, sampling and blending of particulate materials from the lower region of the vessel.

17 Claims, 8 Drawing Figures

METHOD AND APPARATUS FOR BLENDING SOLIDS OR THE LIKE

The invention relates generally to improvements in blending particulate materials or solids, and more particularly, but not by way of limitation, to improved method and apparatus for such blending of particulate materials.

It is often necessary to blend or homogenize hopper car- or truck-size batches of particulate materials or solids in order to produce uniform mixtures. In the plastics industry, for example, slight variations in properties of polymers may occur in different production runs. Blending of the pellets made in such runs is important to insure products of uniform quality. As disclosed in U.S. Pat. Nos. 3,216,629, 3,275,303, 3,456,922 and 4,068,828, efficient blending of particulate materials can be accomplished by the use of apparatus which comprises a vessel having a plurality of vertically extending conduits therein. The solids to be blended are positioned within the vessel surrounding the conduits. The conduits are provided with openings through which the particles enter the conduits to flow by gravity downwardly through the conduits to a common collection zone.

While blending apparatus of the general type disclosed in the foregoing patents has been found to be quite effective, it has been found to be desirable to obtain improved sampling and blending of particulate materials or solids from the lower region of such blending apparatus.

In accordance with the present invention, improved blenders of the general type described above are provided. The blenders of the present invention employ a baffle which blocks a substantial amount of communication between the upper region of the blender vessel and the lower region of the blender vessel. The lower region of the blender vessel is defined by a downwardly converging, preferably frustoconically shaped, bottom wall terminating in a solids outlet at its lowermost portion. The baffle comprises an inverted generally conically shaped portion which portion is spaced inwardly from the bottom wall to form a downwardly converging annular passage therebetween which communicates between the upper region of the vessel and the solids outlet. At least one drain conduit communicates between a conduit which is in communication with a sampling point in the upper region of the vessel and a corresponding opening in the bottom wall, the drain conduit being adapted to convey solids by gravity therethrough from a location in the lower region of the vessel to the conduit.

It is an object of the present invention to provide improved blender apparatus for sampling and blending particulate materials or solids.

It is another object of the invention to provide an improved method of sampling and blending particular materials or solids.

It is yet another object of the present invention to provide method and apparatus for improving the sampling, blending and flow of particulate materials or solids from the lower region of a blender vessel.

It is still another object of the present invention to provide improved method and apparatus for sampling and blending particulate materials or solids which method and apparatus are reliable and economical in operation.

Other aspects, advantages, and objects of the present invention will become readily apparent to those skilled in the art upon further study of the instant specification, claims and drawings in which:

Figure 1:
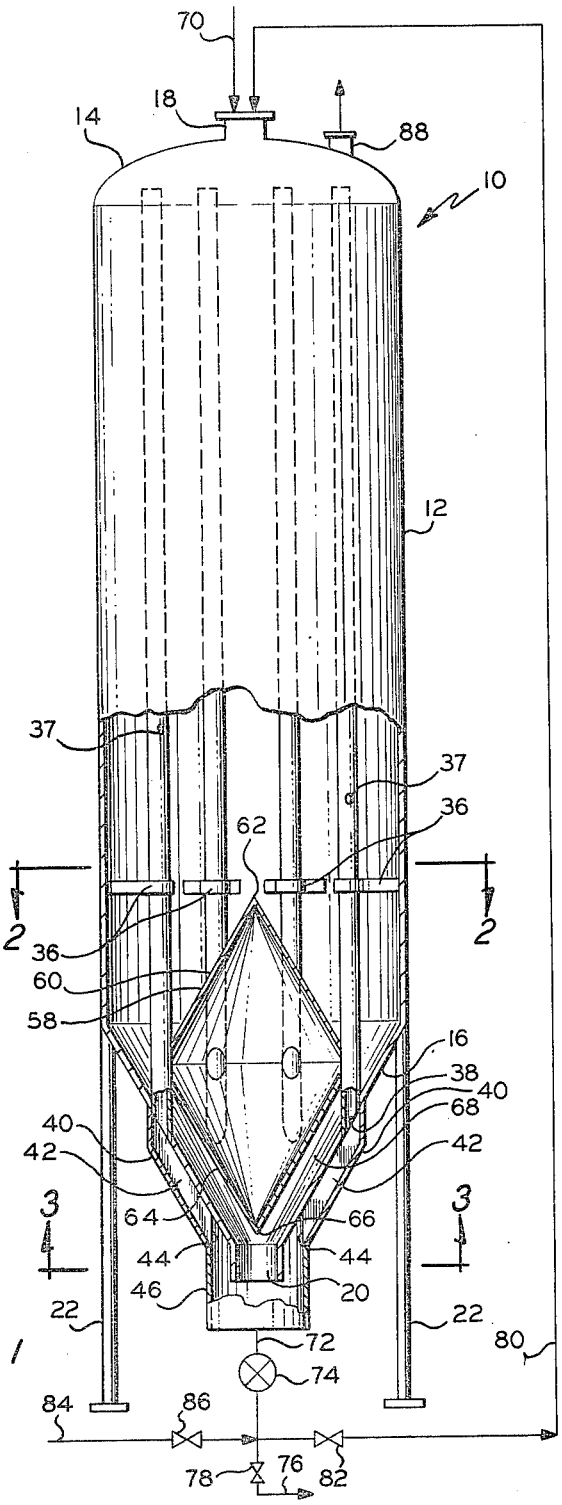
FIG. 1 is a side elevation view of one embodiment of the present invention with portions thereof broken away to illustrate the lower portion of the blender in vertical cross section.
Figure 2:
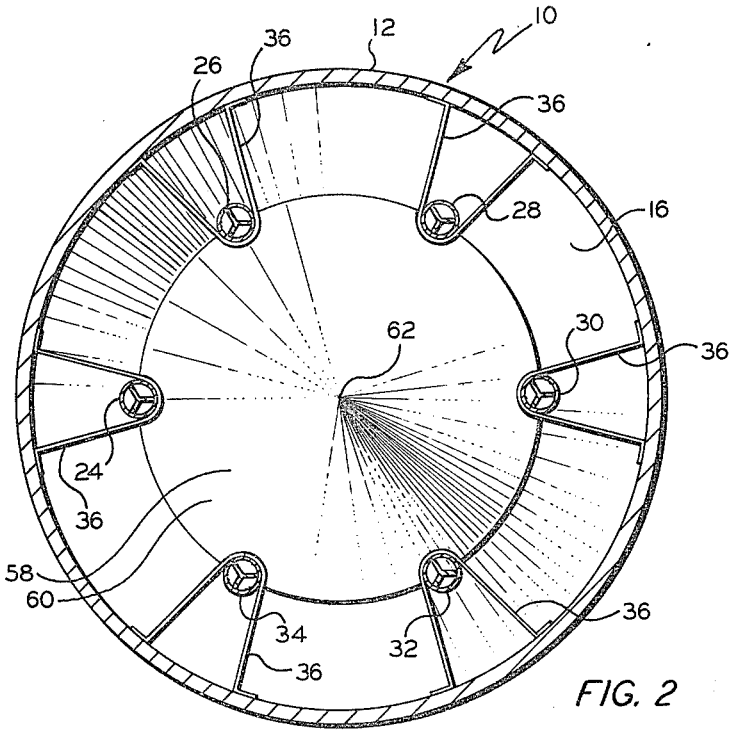
FIG. 2 is a horizontal cross section view taken along line 2—2 of FIG. 1.

Referring now to the drawings, and to FIGS. 1 and 2 in particular, there is illustrated therein an upright, generally cylindrical vessel 10 comprising a generally cylindrical sidewall 12, a top closure 14, and a downwardly converging, generally frustoconically shaped bottom wall or closure 16. The top closure 14 is provided with a solids inlet or filling port 18, and the bottom wall or closure 16 is provided with a solids outlet or withdrawal pipe 20 which communicates with the convergent lower end portion of the bottom wall 16. The vessel 10 can be suitably supported in a vertical position by means of a plurality of legs 22. The sidewall 12 and top closure 14 define and enclose the upper region of the vessel 10, while the bottom wall 16 defines and encloses the lower region of the vessel 10.

A plurality of conduits 24, 26, 28, 30, 32 and 34 are positioned in the upper region of the vessel 10 by means of suitable supports 36 so that the conduits are secured in generally vertical mutually parallel relation within the vessel. The upper end portion of each of the conduits is provided with at least one opening 37 therein providing communication between the interior of the conduit and the upper region of the vessel 10. The lower end portion of each of the conduits extends downwardly through the lower region of the vessel 10 and communicates with the corresponding opening 38 in the bottom wall 16, which opening 38 in turn communicates with the upper end portion 40 of a corresponding first inclined conduit 42 which communicates at the lower end portion 44 thereof with the interior of an outlet conduit 46 which surrounds and is concentrically aligned with the solids outlet 20.

Figure 3:
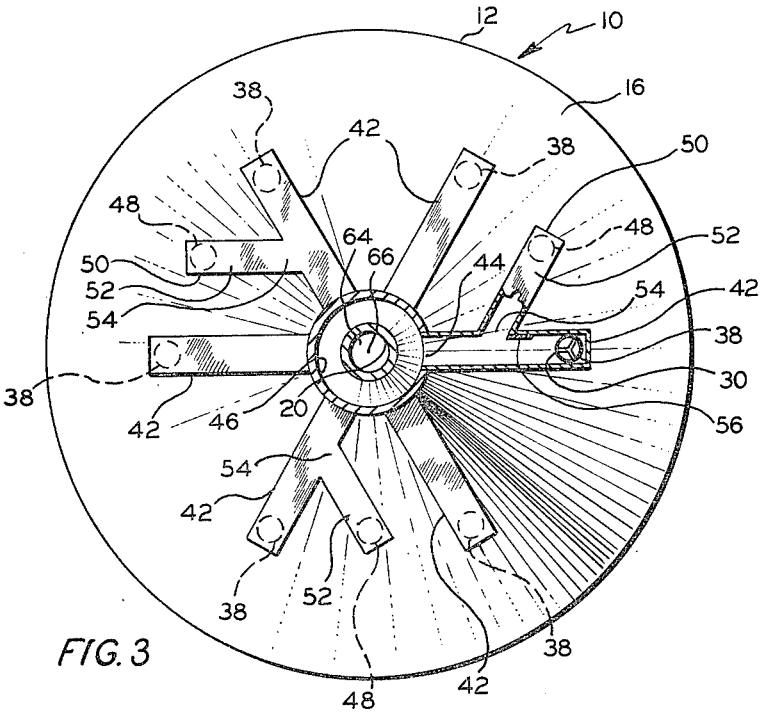
FIG. 3 is a horizontal cross section view taken along line 3—3 of FIG. 1.

As shown in FIG. 3, at least one, and preferably a plurality of openings 48 are located in the bottom wall 16 of the vessel 10 intermediate the upper region of the vessel and the solids outlet 20. In the embodiment shown in FIG. 3, the openings 48 are employed with each opening 48 being preferably substantially equidistant from the next adjacent openings 38. Each opening 48 provides flow communication between the interior of the lower region of the vessel 10 and the upper end portion 50 of a corresponding drain conduit 52. The lower end portion 54 of each drain conduit 52 is in flow communication with a corresponding first inclined conduit 42.

Each drain conduit 52 provides means for conveying particulate materials or solids by gravity therethrough from a location in the lower region of the vessel 10 via a corresponding opening 48 to a corresponding first inclined conduit 42. The openings 48 can all be spaced the same distance downwardly along the bottom wall 16 from the sidewall 12 or upper region of the vessel 10, or, alternately, each opening 48 can be spaced a distance downwardly along the bottom wall 16 from the sidewall 18 or upper region of the vessel 10 which is different from the distance by which at least one of the other openings 48 is spaced downwardly along the bottom wall 16 from the sidewall 12 or upper region of the vessel 10, as shown in FIG. 3.

It is also deemed preferably to include a baffle 56 positioned within a corresponding first inclined conduit 42 adjacent and upstream of the point of communication between the corresponding first inclined conduit 42 and the corresponding drain conduit 52, as shown in FIG. 3, to provide a region of reduced cross sectional area in the first inclined conduit 42 upstream of the point of communication with the corresponding drain conduit 52. This region of reduced cross sectional area is less than the cross sectional area in the first inclined conduit 42 at and downstream of the point of communication between the first inclined conduit 42 and the corresponding drain conduit 52. The use of a baffle 56 will permit the continuous introduction of a stream of particulate materials or solids from the corresponding drain conduit 52 into the corresponding first inclined conduit 42 as the particulate materials or solids are passing downwardly through the vessel 10.

Figure 4:
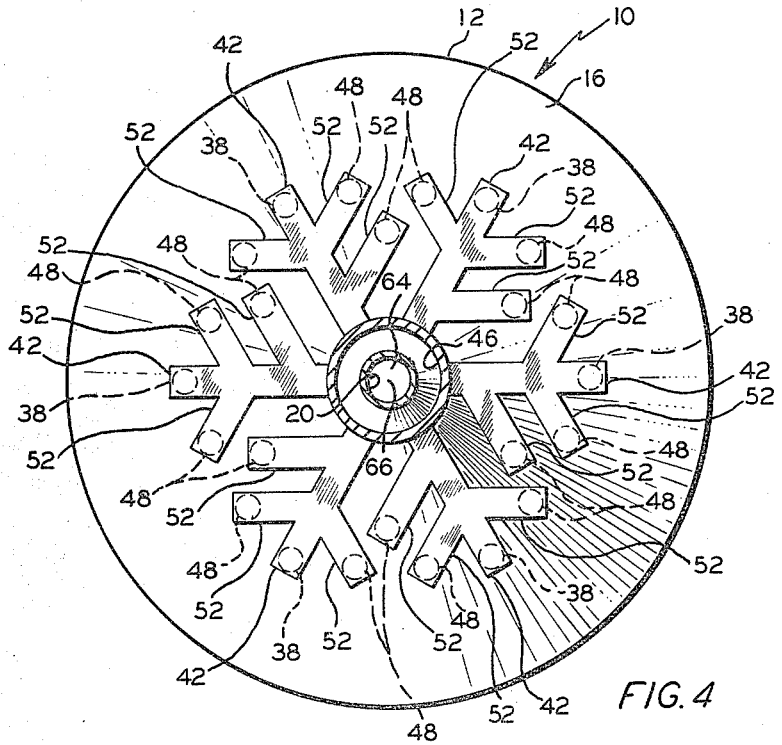
FIG. 4 is a horizontal cross section view similar to FIG. 3 illustrating another embodiment of the present invention.

The embodiment of FIG. 3 illustrates a vessel 10 which is provided with three openings 48 and three corresponding drain conduits 52 which communicate with alternate first inclined conduits 42. FIG. 4 illustrates another embodiment wherein each first inclined conduit 42 communicates with three drain conduits 52, each drain conduit 52, in turn, communicating with a corresponding opening 48 in the bottom wall 16 and providing means for conveying particulate materials or solids therethrough from a location in the lower region in the vessel 10 to the corresponding first inclined conduit.

Figure 7:
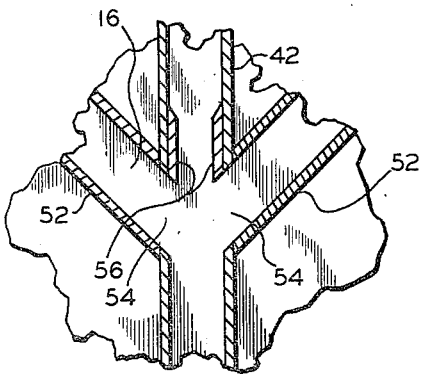
FIG. 7 is an enlarged detail cross section view illustrating a form of interconnection between conduits of generally rectangular cross section.

In the embodiments illustrated in both FIG. 3 and FIG. 4, the conduits 42 and 52 are constructed with generally rectangular cross sections, and conveniently employ the exterior surface of the bottom wall 16 to define the top wall of each of the conduits 42 and 52. FIG. 7 illustrates a typical junction between the generally rectangular conduits of 42 and 52, as shown in FIG. 4, and further shows the preferred locations of the baffles 56 at the points of communication between the drain conduits 52 and the corresponding first inclined conduit 42 as described above.

Referring again to FIGS. 1 and 2, a baffle 58 is disposed within the vessel 10 between the upper region and the lower region and blocks a substantial amount of communication between the upper and the lower regions. The baffle 58 comprises a first generally conically shaped portion 60 with the apex 62 thereof pointed upwardly, and an inverted second generally conically shaped portion 64 with the apex 66 thereof pointed downwardly. The second generally conically shaped portion 64 will be understood to include within its definition an inverted frustoconically shaped portion with the apparent apex thereof pointed downwardly. The second generally conically shaped portion 64 is positioned beneath and fixedly secured to the first generally conically shaped portion 60 and is spaced from the bottom wall 16 of the vessel 10 to form a downwardly converging annular passage 68 therebetween, which passage communicates between the upper region and the solids outlet 20 of the vessel 10. It is presently preferred that the apical angles of the first and second conically shaped portions 60 and 64, as well as the apical angle of the frustonically shaped bottom wall 16, are all approximately 60°, although smaller or larger apical angles in the range from about 40° to about 80° can be used depending upon the flow characteristics of the particulate materials being blended.

The configuration of the baffle 58 and its position relative to the upper region and the bottom wall 16 of the vessel 10 are advantageous in that they serve to decrease the inventory of particulate materials or solids below the baffle 58 in the annular passage 68 where the only exits are provided by the solids outlet 20 and the additional openings 48 in the bottom wall 16. The baffle 58 provides the additional advantage of preventing or substantially reducing the occurrence of tunneling or "rat-holing" of poorly flowing particulate materials and the occurrence of arching of particulate materials over the solids outlet 20 by decreasing the head of particulate materials or solids on the outlet.

As illustrated in FIG. 1, the vessel 10 can be filled with particulate materials or solids to be blended by means of a conduit 70 which communicates with the solids inlet 18. A conduit 72, having control means such as a rotary star valve 74 interposed therein, is connected to outlet conduit 46 to withdraw blended particulate materials or solids. Conduit 72 is connected to a withdrawal conduit 76 in which a valve 78 is interposed. In some operations it may be desirable to recycle blended particulate materials or solids from the conduit 72 back to the upper region of the vessel 10. This can be accomplished by means of a conduit 80, having a valve 82 interposed therein, which extends from conduit 72 to the solids inlet 18. A conduit 84, having a valve 86 interposed therein, extends from a source of pneumatic pressure, not shown, to the inlet of conduit 80. The blended particulate materials or solids can thus be elevated and reintroduced into the vessel 10 via conduit 80 by means of pressurized air from the source of pneumatic pressure. The top closure 14 can be provided with a vent 88 to permit the transport air entering from the conduit 80 to be exhausted from the vessel 10.

In a first method of operation in accordance with this invention, the rotation of valve 74 is stopped to block flow through the valve 74 and the vessel 10 is filled with particulate materials or solids to be blended via the conduit 70. The valve 74 is then rotated to allow flow therethrough and the valve 78 is opened to permit the particulate materials or solids to drain by gravity from the vessel 10 to the withdrawal conduit 76. Valve 86 is closed at this time so that no particulate materials or solids are recycled. In another embodiment of this invention, the vessel 10 can be operated in the same manner except that blending is accomplished continuously with particulate materials or solids to be blended being introduced through the solids inlet 18 and withdrawn through conduit 72 at the same time. In still another method of operation, a part or all of the blended particulate materials or solids can be recycled through conduit 80 back to the solids inlet 18 for further blending. Even in the single pass batch blending procedure first described above, it is usually desirable to recycle a part of the blend of particulate materials or solids initially withdrawn from the outlet conduit 46.

The construction of the conduits 24, 26, 28, 30, 32 and 34 can be any suitable construction which will achieve desired blending of particulate materials or solids in the vessel 10. Suitable conduit construction is disclosed in U.S. Pat. No. 4,068,828 issued to the inventor of the instant invention and assigned to Phillips Petroleum Company, and the conduit construction disclosed in this patent is incorporated by reference herein. It should be noted that the baffle means disclosed in U.S. Pat. No. 4,068,828 to reduce the flow of particulate materials past the openings in the conduits are optional in the apparatus of the present invention.

Figure 8:
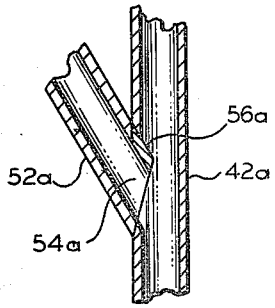
FIG. 8 is an enlarged detail cross section view illustrating a form of interconnection between conduits of generally circular cross section.
Figure 5:
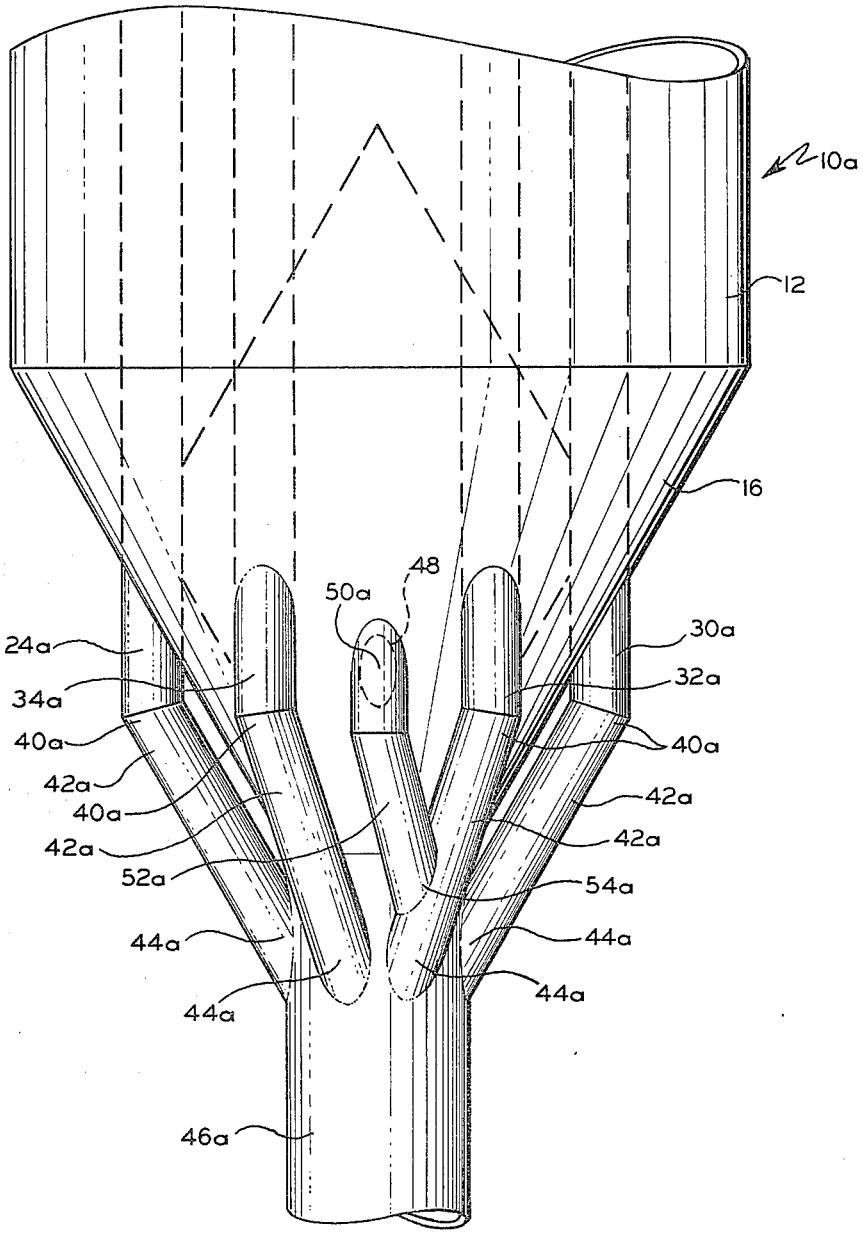
FIG. 5 is a partial side elevation view of another embodiment of the present invention.
Figure 6:
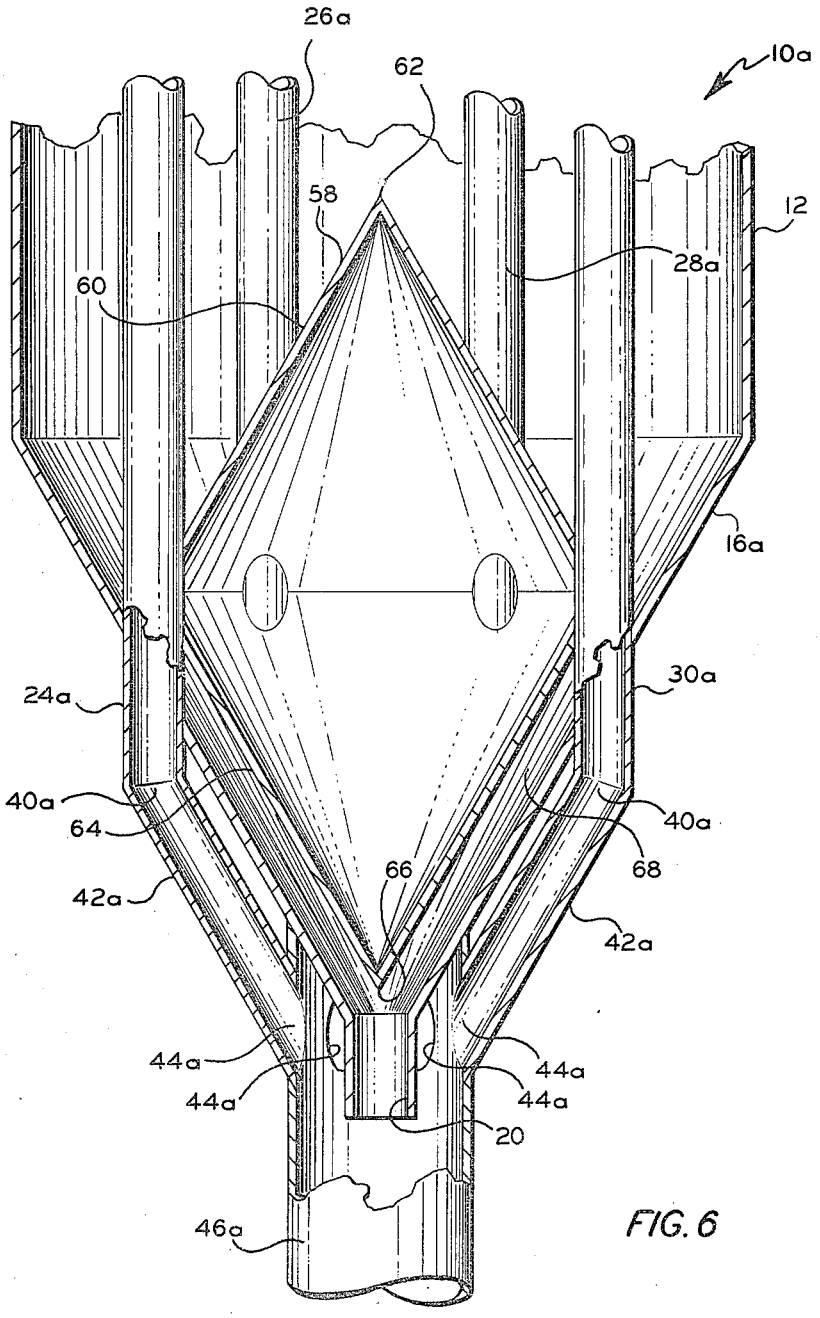
FIG. 6 is a partial vertical cross section view showing interior construction details of the embodiment of FIG. 5.

Referring now to FIGS. 5 and 6, an alternate embodiment of the vessel of the present invention is disclosed therein and is generally designated by the reference character 10*a*. The vessel 10*a* differs from the vessel 10 in that slightly modified first inclined conduits 42*a* and drain conduits 52*a* of substantially circular cross section are employed in the construction of the vessel 10*a*. The upper end portion 40*a* of each of the first inclined conduits 42*a* is in flow communication with the lower end portion of a corresponding one of the slightly modified conduits 24*a*, 26*a*, 28*a*, 30*a*, 32*a* and 34*a*. The lower end portion 44*a* of each of the first inclined conduits 42*a* is in flow communication with a slightly modified outlet conduit 46*a*. Each modified drain conduit 52*a*, only one shown, is in full communication at its upper end portion 50*a* with a corresponding opening 48 in the bottom wall or closure 16 of the vessel 10*a*. The lower end portion 54*a* of each drain conduit 52*a* is in flow communication with a corresponding modified first inclined conduit 42*a*, as illustrated in FIGS. 5 and 8. It is also deemed preferable, as further shown in FIG. 8, to include a baffle 54*a*, positioned within a corresponding first inclined conduit 42*a* adjacent and upstream of the point of communication between the corresponding first inclined conduit 42*a* and the corresponding drain 52*a* to provide a region of reduced cross sectional area in the first inclined conduit 42*a* upstream of the point of communication with the corresponding drain conduit 52*a* which is less than the cross sectional area in the first inclined conduit 42*a* at and downstream of the point of communication. The use of the baffle 54*a* will permit the continuous introduction of a stream of solids from the corresponding drain conduit 52*a* into the corresponding first inclined conduit 42*a* as solids are passed downwardly through the vessel 10*a*. The remaining structure of the vessel 10*a* is identical to and functions in the same manner as the previously described vessel 10. It will be understood that the various schemes for location of the drain conduits 52 and openings 48 described above and shown in FIGS. 3 and 4 are equally applicable to the slightly modified drain conduits 52*a* and openings 48 of the slightly modified vessel 10*a*.

From the foregoing detailed description, it will be seen that the apparatus and method of its use described and illustrated herein eminently achieves the objects of the present invention. Changes may be made in the combination and arrangement of parts or elements is heretofore set forth in the specification and shown in the drawings without departing from the spirit and scope of the invention as defined in and limited only by the following claims.

That which is claimed is:

1. Solids blending apparatus comprising:

a vessel having a solids inlet in an upper region thereof and solids outlet means in a lower region thereof, the lower region being defined by a downwardly converging generally frustoconically shaped bottom wall;

a plurality of conduits each positioned within said vessel so as to extend in a generally vertical direction downwardly from said upper region through said lower region and through said bottom wall, each of said conduits having at least one first opening therein in said upper region to permit solids in said upper region to enter the conduit and flow by gravity downwardly toward said lower region;

first inclined conuit means communicating between the lower end of each of said conduits and said solids outlet means for conveying solids by gravity therethrough from each of said conduits to said solids outlet means; and at least one drain conduit means communicating between a corresponding first inclined conduit means and a corresponding opening in said bottom wall intermediate said upper region and said solids outlet means for conveying solids by gravity therethrough from a location in said lower region to said corresponding first inclined conduit means.

2. In a solids blending apparatus of the type which includes:

a vessel having an upper region with a solids inlet therein and a lower region defined by a downwardly converging bottom wall with solids outlet means therein;

a plurality of conduits each positioned relative to said vessel so as to extend in a generally vertical direction downwardly from said upper region to a point at least as low as said lower region, with each of said conduits having at least one first opening therein in flow communication with the upper region of the interior of said vessel to permit solids in said upper region to enter the conduit and flow by gravity downwardly through the conduit toward said lower region; and first conduit means in flow communication between the lower end of said conduits and said solids outlet means for conveying solids by gravity therethrough from each of said conduits to said solids outlet means;

the improvement wherein said apparatus further comprises:

at least one drain conduit means in flow communication between a corresponding first conduit means and a corresponding opening in said bottom wall intermediate said upper region and said solids outlet means for conveying solids by gravity therethrough from a location in said lower region to said corresponding first conduit means, said at least one drain conduit means communicating with a corresponding opening in said bottom wall at a location intermediate said corresponding first conduit means and a next adjacent first conduit means.

3. Solids blending apparatus in accordance with claim 1 wherein said at least one drain conduit means communicates with a corresponding opening in said bottom wall at a location intermediate said corresponding first conduit means and a next adjacent first conduit means.

4. Solids blending apparatus in accordance with claim 1 or claim 2 characterized further to include at least one second drain conduit means communicating between said corresponding first conduit means and a corresponding second opening in said bottom wall intermediate said upper region and said solids outlet means for conveying solids by gravity therethrough from a second location in said lower region to said corresponding first conduit means.

5. Solids blending apparatus in accordance with claim 4 wherein said at least one drain conduit means communicates with the corresponding opening in said bottom wall at a location intermediate said corresponding first conduit means and one next adjacent first conduit means and said at least one second drain conduit means communicates with a corresponding second opening in said bottom wall at a location intermediate said corresponding first conduit means and another next adjacent first conduit means.

6. Solids blending apparatus in accordance with claim 5 wherein the corresponding opening in said bottom wall is located nearer to said upper region than is the corresponding second opening in said bottom wall.

7. Solids blending apparatus in accordance with claim 5 characterized further to include at least three of said conduits.

8. Solids blending apparatus in accordance with claim 2 or claim 3 characterized further to include at least three of said conduits, at least three of said first conduit means each communicating with a corresponding one of said conduits and one of said drain conduit means communicating with each one of at least two of said first conduit means, wherein each of said drain conduit means communicates with said corresponding opening in said bottom wall at a location spaced a distance from said upper region which is different from the distance between the location of the at least one other opening and the upper region.

9. Solids blending apparatus in accordance with claim 8 characterized further to include six of said conduits, six of said first conduit means and three drain conduit means communicating with corresponding alternate first conduit means; and a baffle disposed within said vessel between said upper region and said lower region, said baffle blocking a substantial amount of communication between said upper and lower regions, and said baffle comprising a first generally conically shaped portion with the apex thereof pointed upwardly and an inverted second generally conically shaped portion, said second generally conically shaped portion being positioned beneath said first generally conically shaped portion and spaced from the bottom wall of said vessel to form a downwardly converging annular passage therebetween communicating between said upper region and said solids outlet means.

10. Solids blending apparatus in accordance with claim 9 characterized further to include baffle means located within each of said corresponding alternate first conduit means adjacent and upstream of the point of communication with the corresponding drain conduit means for providing a region of reduced cross sectional area in said first conduit means upstream of the point of communication with the corresponding drain conduit means which cross sectional area is less than the cross sectional area in said corresponding alternate first conduit means at and downstream of the point of communication with the corresponding drain conduit means.

11. Solids blending apparatus in accordance with claim 1 or claim 2 characterized further to include baffle means located within each of said corresponding first conduit means adjacent and upstream of the point of communication with the corresponding drain conduit means for providing a region of reduced cross sectional area in said first conduit means upstream of the point of communication with the corresponding drain conduit means which cross sectional area is less than the cross sectional area in said corresponding first conduit means at and downstream of the point of communication with the corresponding drain conduit means.

12. Solids blending apparatus in accordance with claim 1 or claim 2 wherein the cross sectional area within each said corresponding first conduit means adjacent and upstream of the point of communication with the corresponding drain conduit means is less than the cross sectional area within said corresponding first conduit means at and downstream of the point of communication with the corresponding drain conduit means.

13. A method of blending solids in solids blending apparatus comprising a vessel having a solids inlet in an upper region thereof and solids outlet means in a lower region thereof, the lower region being defined by a downwardly converging generally frustoconically shaped bottom wall; a plurality of conduits each positioned within said vessel so as to extend in a generally vertical direction downwardly from said upper region through said lower region and through said bottom wall, each of said conduits having at least one first opening therein in said upper region to permit solids in said upper region to enter the conduit and flow by gravity downwardly toward said lower region; first inclined conduit means communicating between the lower end of each of said conduits and said solids outlet means for conveying solids by gravity therethrough from each of said conduits to said solids outlet means; and at least one drain conduit means communicating between a corresponding first inclined conduit means and a corresponding opening in said bottom wall intermediate said upper region and said solids outlet means for conveying solids by gravity therethrough from a location in said lower region to said corresponding first inclined conduit means, which comprises:

introducing solids to be blended into the vessel through said solids inlet, and withdrawing blended solids through said solids outlet means.

14. A method of blending solids in solids blending apparatus comprising a vessel having an upper region with a solids inlet therein and a lower region defined by a downwardly converging bottom wall with solids outlet means therein; a plurality of conduits each positioned relative to said vessel so as to extend in a generally vertical direction downwardly from said upper region to a point at least as low as said lower region, with each of said conduits having at least one first opening therein in flow communication with the upper region of the interior of said vessel to permit solids in said upper region to enter the conduit and flow by gravity downwardly through the conduit toward said lower region; first conduit means in flow communication between the lower end of said conduits and said solids outlet means for conveying solids by gravity therethrough from each of said conduits to said solids outlet means; and at least one drain conduit means in flow communication between a corresponding first conduit means and a corresponding opening in said bottom wall intermediate said upper region and said solids outlet means for conveying solids by gravity therethrough from a location in said lower region to said corresponding first conduit means, said at least one drain conduit means communicating with a corresponding opening in said bottom wall at a location intermediate said corresponding first conduit means and a next adjacent first conduit means, which comprises:

introducing solids to be blended into the vessel through said solids inlet, and withdrawing blended solids through said solids outlet means.

15. A method of blending solids in accordance with claim 13 or claim 14 wherein solids are not withdrawn from said solids outlet means until all of the solids to be blended at a given time are disposed in said vessel.

16. A method of blending solids in accordance with claim 13 or claim 14 wherein solids are withdrawn from said solids outlet means during the time that solids are introduced through said soilds inlet.

17. A method of blending solids in accordance with claim 13 or claim 14 wherein a portion of the solids withdrawn from said solids outlet means are returned to an upper portion of said upper region.

* * * * *

UNITED STATES PATENT AND TRADEMARK OFFICE

CERTIFICATE OF CORRECTION

PATENT NO. : U. S. 4,472,064

DATED : September 18, 1984

INVENTOR(S) : Robert R. Goins

It is certified that error appears in the above-identified patent and that said Letters Patent is hereby corrected as shown below:

The inventor's name is given as Robert Goins. It should be --- Robert R. Goins ---.

Signed and Sealed this

*Fourth* Day of *June 1985*

[SEAL]

*Attest:*

DONALD J. QUIGG

*Attesting Officer* *Acting Commissioner of Patents and Trademarks*